US011235960B2

(12) United States Patent
Pirri et al.

(10) Patent No.: US 11,235,960 B2
(45) Date of Patent: Feb. 1, 2022

(54) MOBILE LIFTING APPARATUS

(71) Applicant: CIFA S.p.A., Senago (IT)

(72) Inventors: Nicola Pirri, Milan (IT); Davide Zenato, Milan (IT)

(73) Assignee: CIFA S.p.A., Senago (IT)

( * ) Notice: Subject to any disclaimer, the term of this patent is extended or adjusted under 35 U.S.C. 154(b) by 0 days.

(21) Appl. No.: 16/892,553

(22) Filed: Jun. 4, 2020

(65) Prior Publication Data

US 2020/0385245 A1 Dec. 10, 2020

(30) Foreign Application Priority Data

Jun. 4, 2019 (IT) ..... 102019000008010

(51) Int. Cl.

*B66C 23/00* (2006.01)
*B66C 23/38* (2006.01)
*B66C 13/22* (2006.01)

(52) U.S. Cl.

CPC ..... *B66C 23/38* (2013.01); *B66C 13/22* (2013.01); *B66C 2700/0357* (2013.01); *B66C 2700/08* (2013.01)

(58) Field of Classification Search

CPC ..... B66C 23/38; B66C 13/22; B66C 13/23; B66C 13/28; B66C 2700/0357; B66C 2700/08

See application file for complete search history.

(56) References Cited

U.S. PATENT DOCUMENTS

| | | | | |
|---|---|---|---|---|
| 6,688,481 | B1 * | 2/2004 | Adner | B60L 50/61 212/195 |
| 2008/0048497 | A1 * | 2/2008 | Donnelly | B66C 19/007 307/19 |
| 2009/0194000 | A1 * | 8/2009 | Jacob | B61D 15/02 105/72.2 |
| 2011/0175579 | A1 * | 7/2011 | Mazumdar | E02F 9/207 320/167 |
| 2012/0160796 | A1 * | 6/2012 | Weckbecker | B66D 1/12 212/284 |
| 2014/0314533 | A1 * | 10/2014 | Seales | B60P 1/5428 414/542 |
| 2016/0257293 | A1 * | 9/2016 | Takahashi | B60W 10/08 |
| 2017/0174488 | A1 * | 6/2017 | Sheeley | B66F 11/046 |
| 2019/0055112 | A1 * | 2/2019 | Kosterke | B66D 1/36 |

FOREIGN PATENT DOCUMENTS

| | | | | |
|---|---|---|---|---|
| DE | 10 2012 201140 | | 8/2013 | |
| EP | 2 441 611 | | 4/2012 | |
| GB | 614124 | A * | 12/1948 | B66C 23/36 |
| WO | WO-2012115567 | A1 * | 8/2012 | B66C 13/40 |

OTHER PUBLICATIONS

Italian Search Report of application No. IT 201900008010 dated Feb. 13, 2020, 2 pages.

* cited by examiner

*Primary Examiner* — Emmanuel M Marcelo
(74) *Attorney, Agent, or Firm* — Rankin, Hill & Clark LLP

(57) ABSTRACT

A mobile lifting apparatus, comprising at least one truck, provided with a first drive device comprising at least one internal combustion engine connected by power transmission means to one or more user devices of the truck hydraulically actuated, and at least one boom provided with a second drive device.

8 Claims, 4 Drawing Sheets

MOBILE LIFTING APPARATUS

FIELD OF THE INVENTION

The present invention concerns a mobile lifting apparatus, such as for example a mobile crane, a crane truck or suchlike, provided with a moving truck comprising at least a first drive motor, and a boom comprising at least a second drive motor and a lifting arm.

BACKGROUND OF THE INVENTION

It is known that there are mobile lifting apparatuses, such as for example mobile cranes or suchlike, provided with a truck that is used to drive and take the lifting apparatus to the work site, where the lifting apparatus is going to be used, and a boom which is mounted on the truck and which is normally provided with an arm that can be rotated and lifted with respect to the truck, for example a telescopic arm, at the end of which there is an end working part, for example a load block or other.

Such mobile lifting apparatuses are also equipped with stabilizing legs, which are extracted before the telescopic arm is used, that is, when the lifting apparatus reaches its destination and is in the work position. The function of stabilizing the lifting apparatus is normally carried out by means of the drive device of the truck.

During transport conditions, the arm mounted on the boom is positioned on the truck, normally in a lowered position and, if this arm is of the telescopic type, the various tubular elements that it is made up of are in a retracted position.

The boom of the lifting apparatus is normally positioned on the truck by means of a support device such as a fifth wheel or suchlike, by means of which the boom can rotate with respect to the truck around a substantially vertical axis.

Furthermore, along the arm of the boom there are provided one or more cables for lifting or lowering loads, which on one end are wound around a winch and on the other end have an end working part, such as a load block or suchlike.

The functions of the boom that have just been described, that is, rotation of the arm, lowering and lifting of the arm, possible extension of the various tubular elements in the case of a telescopic arm, lifting or lowering of the end working part, or others, are normally performed by means of an internal combustion drive engine, associated with hydraulic actuators fed by pumps for supplying a work fluid.

In general, therefore, known mobile lifting apparatuses as above are provided with at least a first internal combustion engine, as regards the movement of the truck and the possible drive of pumps present in the truck, and at least a second internal combustion engine used for the various user devices of the boom, in particular the hydraulically actuated user devices, such as those described above, and for moving the boom itself with respect to the truck.

The use of an internal combustion engine to move the boom and for the various user devices associated with the boom naturally entails emissions of exhaust gases that are harmful both for a person's health and for the environment. Therefore, every time the boom is driven in order to carry out a certain work, the environment surrounding the work site is inevitably subjected to pollution deriving from the emission of harmful substances into the atmosphere.

Furthermore, mobile lifting apparatuses, during the various work steps, often prove to be quite noisy, thus also presenting problems of excessive noise emissions and noise pollution, both for the operators in charge of lifting operations and also for the inhabitants of the areas surrounding the work site.

The presence of internal combustion engines both to move the truck and therefore for the various movements of the lifting apparatus, and also to move the boom and the various user devices associated with it, also entails considerable waste of energy and difficulty in providing effective energy recovery operations.

EP 2.441.611 discloses a lifting apparatus comprising a truck and a boom actuated by an electric motor.

There is therefore the need to perfect a mobile lifting apparatus that can overcome at least one of the disadvantages of the state of the art.

In particular, one purpose of the present invention is to provide a mobile lifting apparatus which is equipped with means for driving the boom and the various user devices associated with the boom which are efficient, silent and which allow at least to drastically limit the environmental pollution caused by the normal use of the mobile lifting apparatus.

Another purpose of the present invention is to provide a mobile lifting apparatus which allows high energy saving compared to known mobile lifting apparatuses, for example in terms of overall fuel used to drive the mobile lifting apparatus.

Another purpose of the present invention is also to provide a mobile lifting apparatus which provides energy recovery methods, which are currently not provided in the mobile lifting apparatuses known in the sector.

The Applicant has devised, tested and embodied the present invention to overcome the shortcomings of the state of the art and to obtain these and other purposes and advantages.

SUMMARY OF THE INVENTION

The present invention is set forth and characterized in the independent claim. The dependent claims describe other characteristics of the invention or variants to the main inventive idea.

In accordance with the above purposes, a mobile lifting apparatus comprises at least one truck, provided with a first drive device comprising at least one internal combustion engine connected by power transmission means to one or more user devices of the truck which are hydraulically actuated, and at least one boom provided with a second drive device.

According to a characteristic aspect of the invention, such second drive device comprises at least one electric motor connected by power transmission means to one or more user devices of the boom.

Advantageously, using a drive device comprising at least one electric motor connected by power transmission means, for example by at least one coupler, to the various user devices of the boom, including for example the movement of the boom itself, allows, compared to a traditional solution that uses an internal combustion engine, to save energy, to reduce emissions of harmful and polluting substances into the surrounding environment, and also to reduce the noise pollution deriving from the use of the boom and its user devices during normal work operations.

The present mobile lifting apparatus therefore proves to be extremely efficient and performing compared to the lifting apparatuses known in the sector and provided with two internal combustion engines, one for moving the truck and one for driving the user devices connected to the boom, including moving the arm of the boom, for example lifting it according to a desired inclination during work operations and lowering it into a horizontal position during transport operations.

According to another aspect of the invention, the electric motor of the second drive device can be connected by at least one energy converter to one or more energy accumulators.

In some embodiments, such first drive device can comprise an electric generator connected to the power transmission means and, by means of at least one energy converter, to the one or more accumulators.

In some embodiments, the present mobile lifting apparatus can comprise at least one charging device connectable to a mains power network and configured to recharge the one or more accumulators.

In some embodiments, the present mobile lifting apparatus can comprise at least one energy recovery device associated with at least one of the user devices of the boom.

Such energy recovery device can be associated with a drive machine configured to lift or lower an end working part, wherein, at least in a step of lowering the end working part due to gravity, the drive machine functions as an electric generator.

In some embodiments, such drive machine can be a winch with which an electric generator is associated.

In other embodiments, such drive machine can be an electric machine, in which the step of lifting and the step of lowering the end working part are managed electronically.

The energy recovery device as above can also comprise at least one energy converter associated with the drive machine and by means of which the energy recovered is transferred to the one or more accumulators.

ILLUSTRATION OF THE DRAWINGS

These and other aspects, characteristics and advantages of the present invention will become apparent from the following description of some embodiments, given as a non-restrictive example with reference to the attached drawings wherein.

Figure 3A:
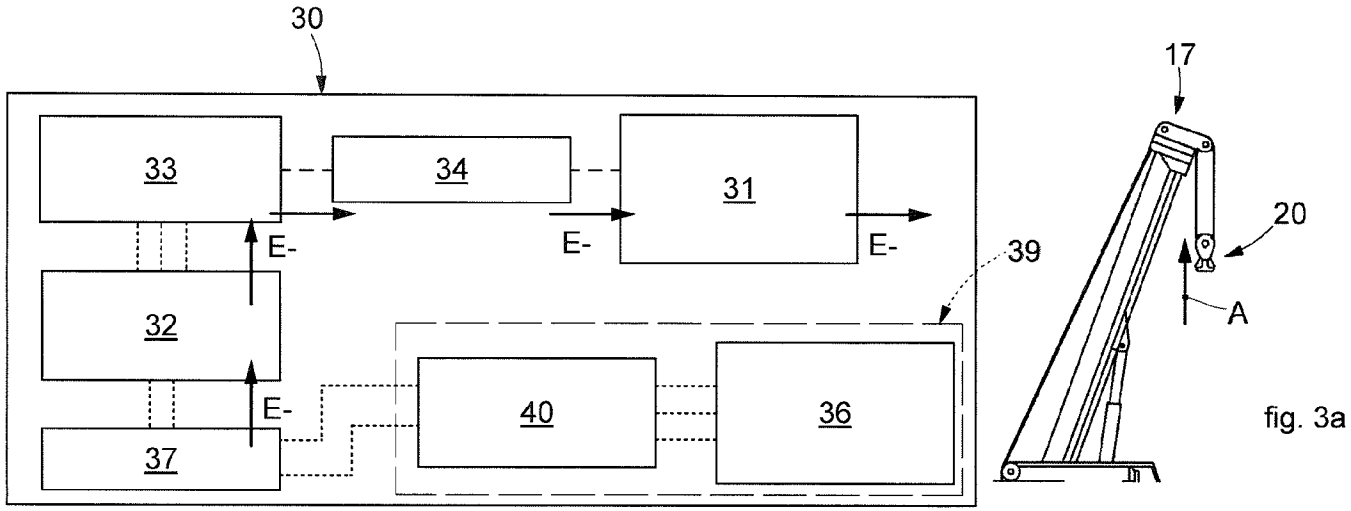
Figure 3B:
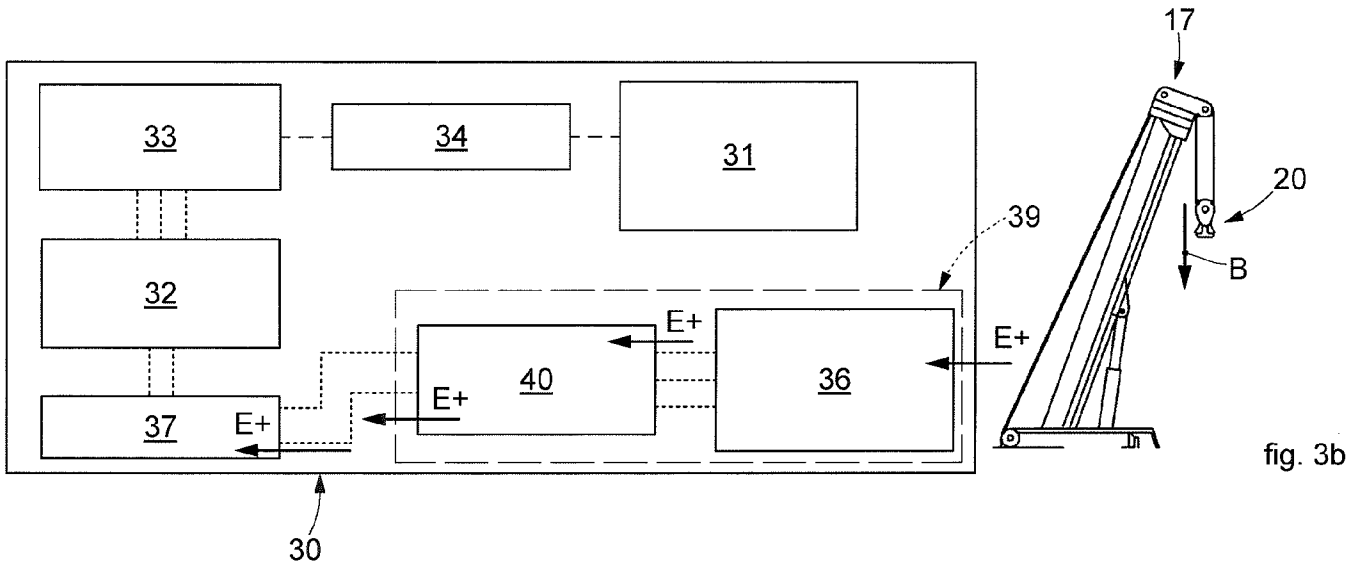
Figure 4:
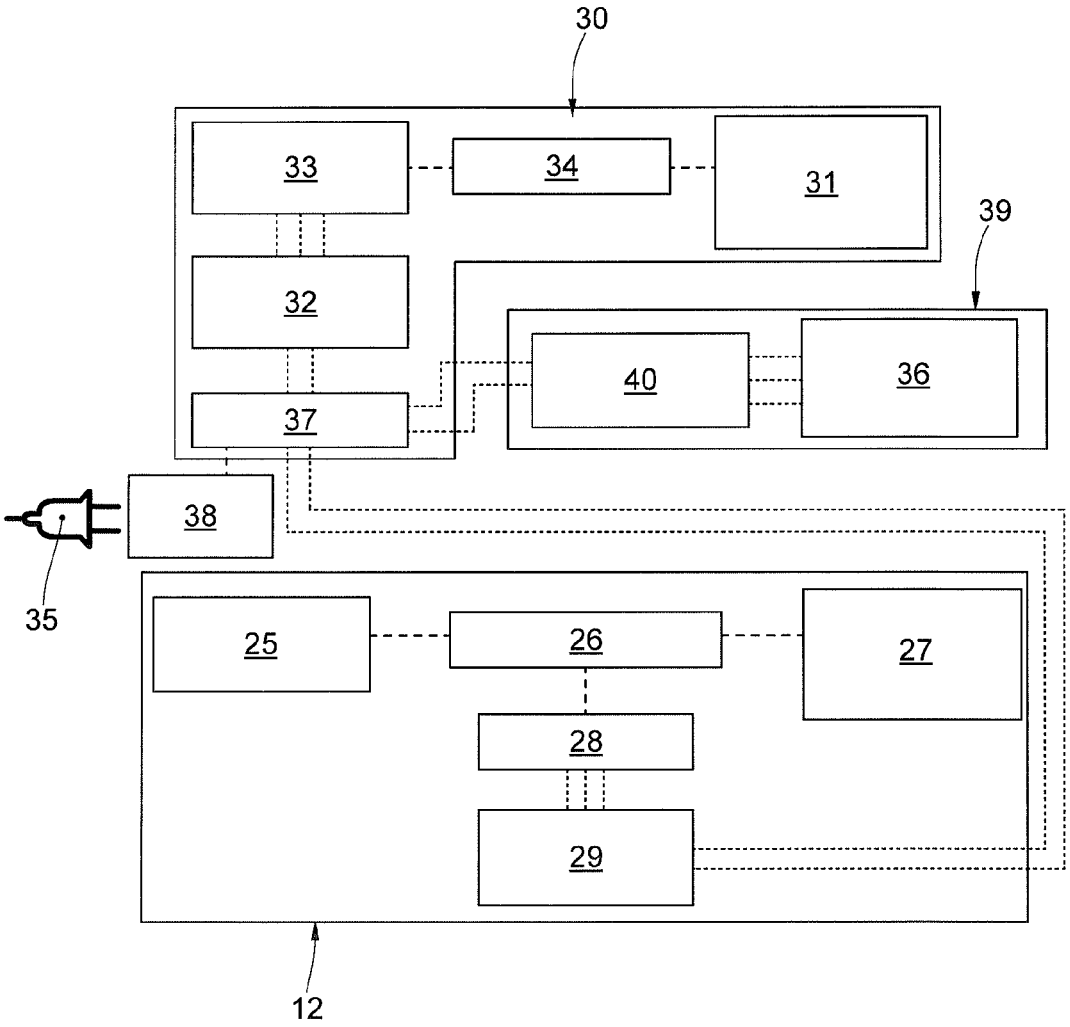

FIGS. 3*a* and 3*b* are two further diagrams of the functioning of the present mobile lifting apparatus relating respectively to a first work mode and to a second work mode with energy recovery;

FIG. 4 is another diagram of the functioning of the present mobile lifting apparatus provided with an energy recovery device.

To facilitate comprehension, the same reference numbers have been used, where possible, to identify identical common elements in the drawings. It is understood that elements and characteristics of one embodiment can conveniently be incorporated into other embodiments without further clarifications.

DESCRIPTION OF SOME EMBODIMENTS

We will now refer in detail to the various embodiments of the invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

Figure 1:
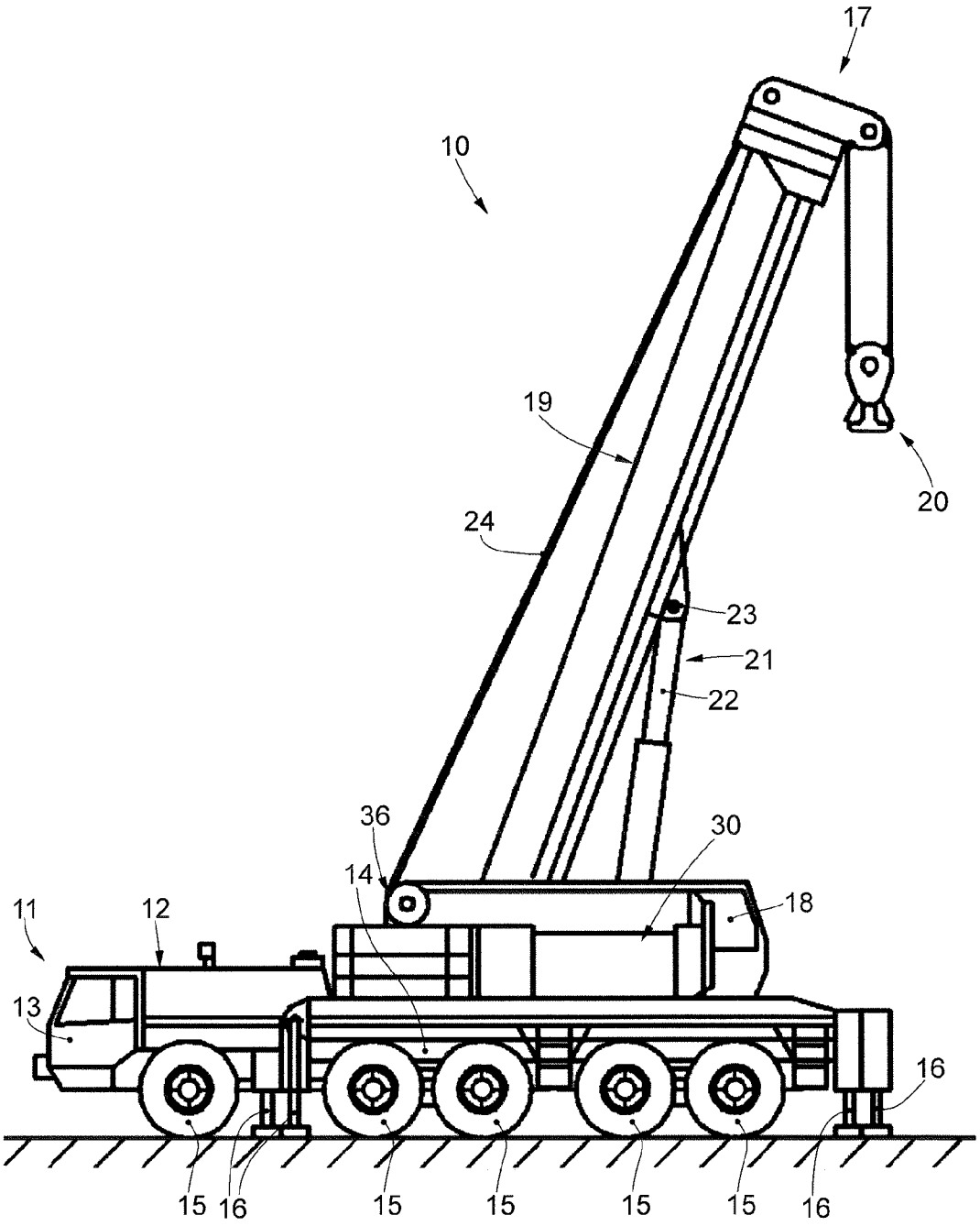
FIG. 1 is a schematic view of a mobile lifting apparatus according to the present invention.

With reference to the attached drawings and with particular reference to FIG. 1 thereof, a mobile lifting apparatus 10 according to the present invention comprises a truck 11 provided with a first drive device 12, able to allow the displacement of the mobile lifting apparatus 10.

The truck 11 comprises at the front a driving cab 13, at the rear of which a frame 14 is schematically shown, and is provided with a series of movement wheels 15.

Such truck 11 also comprises a series of stabilizing legs 16, which are extracted and placed stably on the ground when the mobile lifting apparatus 10 has reached the work site, as in FIG. 1.

Such boom 17 is housed on the frame 14 of the truck 11 by means of a support device, such as a fifth wheel or suchlike, and can be commanded by an operator who assumes position in a cabin 18, which can also be housed on the frame 14, as shown.

The boom 17 comprises an arm 19, for example a telescopic arm consisting of several extendable tubular elements, at the end of which there is positioned an end working part 20, for example a load block, an attachment element or other. For example, a load to be lifted or lowered can be connected to such end working part 20. In FIG. 1 the arm 19 is shown in a lifted work position.

Such boom 17 will also comprise one or more cables 24 connected on one end to a drive machine 36, which will be housed on the frame 14 of the truck 11, and on the other end to the end working part 20. Such drive machine 36 is able to pull or release the cables 24 and therefore lift or lower the end working part 20. Such drive machine 36 has substantially a winch function in the lifting step of the end working part 20, or an electric generator function during the lowering step of the end working part 20.

In some embodiments, such drive machine 36 can be a winch, coupled with an electric generator to recover energy, which occurs as mentioned during the lowering of the end working part 20.

In other embodiments, such drive machine 36 can be an electric machine, therefore managed electrically both in the lifting step and also in the lowering step of the end working part 20, with consequent energy recovery.

In order to lift and lower the arm 19 from an inactive and transport position, for example a substantially horizontal position, to a work position such as that shown in FIG. 1, a movement device 21 is provided which is able to lift and lower it, for example a hydraulic cylinder provided with an extendable stem 22 connected by means of a hinge 23 to the arm 19 of the boom 17. In order to pass from the transport position to the work position, or vice versa, the arm 19 of the boom 17 is also rotatable with respect to the truck 11 around a substantially horizontal axis.

As described above, the truck 11 is provided with a drive device 12 which is able to command the raising and lowering of the stabilizing legs 16, which will be carried out by means of hydraulic actuators to which a work fluid is supplied by means of suitable pumps.

Figure 2:
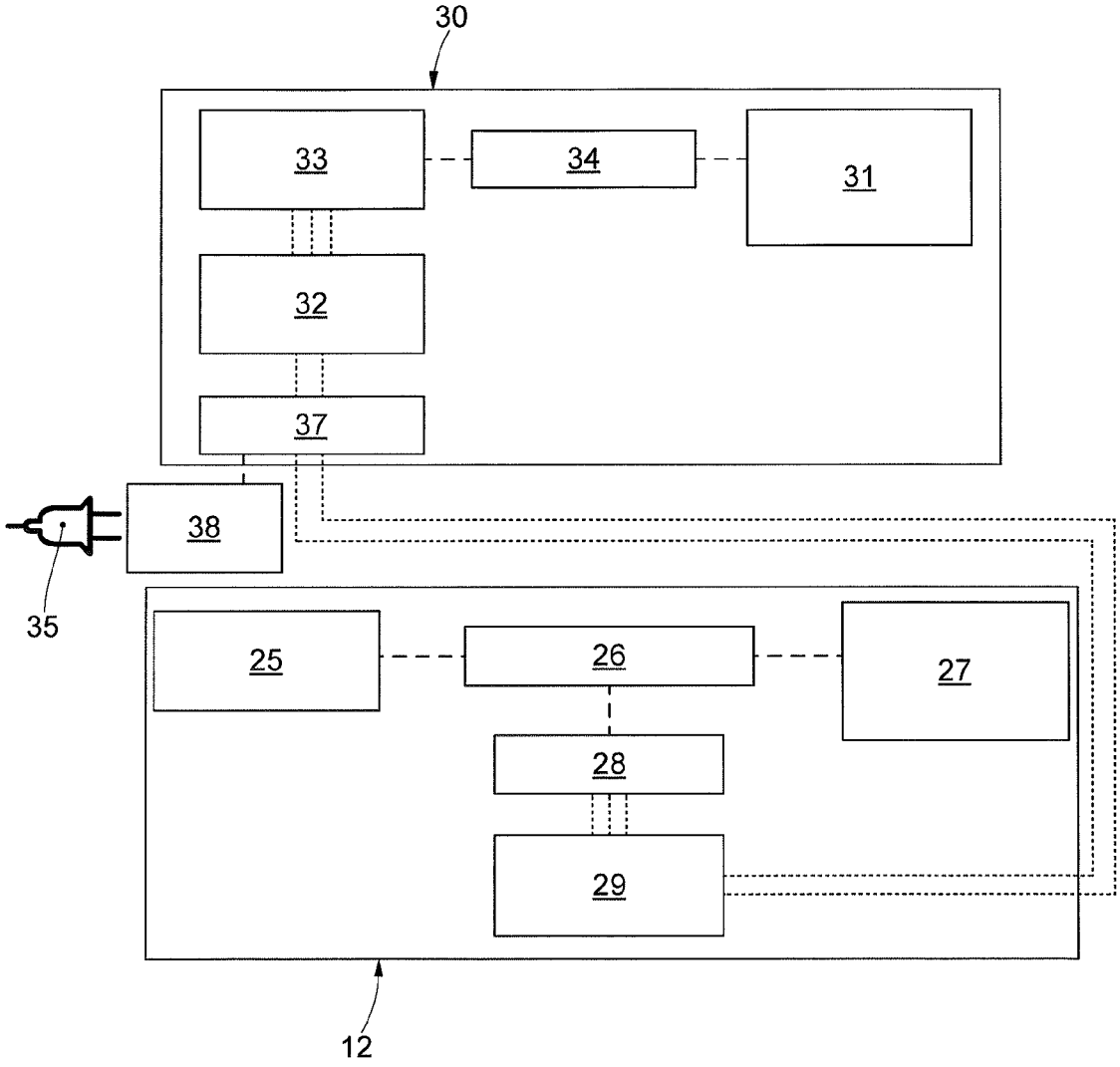
FIG. 2 is a diagram of the functioning of the present mobile lifting apparatus.

Such drive device 12 of the truck 11, see FIG. 2, comprises at least one internal combustion engine 25 connected by power transmission means 26 to one or more pumps of the truck 11 which are associated with one or more user devices 27, therefore for example each pump will be associated with one user device which is hydraulically actuated by means of the drive device of the truck 11.

Such power transmission means 26 can be at least one coupler, single or multiple, to which are connected on one side the internal combustion engine and on the other side the pumps of the various user devices 27 of the truck 11 hydraulically actuated, therefore for example the pumps of the actuators for raising and lowering the stabilizing legs 16 and/or other.

To such power transmission means 26 there is also connected an electric generator 28, to which in turn a converter 29 of electric energy is connected, such as for example an inverter.

One or more user devices 31 are connected to the boom 17, for example hydraulically actuated user devices, for example the lifting of the arm 19 to a desired inclination during work operations or its lowering to a substantially horizontal position during transport operations.

The drive of these user devices 31 associated with the boom 17 is assigned to another drive device 30, see FIG. 1 and FIG. 2. Such user devices can therefore be, for example, the actuator used to make the boom 17 rotate with respect to the truck 11, the movement device 21, the one or more actuators used to extend the tubular elements of the arm 19, if the latter is telescopic, the drive machine 36 for lifting and lowering the end working part 20. At least some of such user devices 31 actuated by the drive device 30 will comprise a corresponding pump installed on power transmission means 34 connected to an electric motor 33. Such power transmission means 34 can comprise at least one coupler.

Such drive device 30 comprises one or more accumulators 37 of electric energy, for example batteries, connected to a converter 32 of electric energy, for example an inverter.

The accumulators 37 can be associated both with the drive device 12 of the truck 11, and also with the drive device 30 of the various user devices 31 of the boom 17. By way of example, in FIG. 2 such accumulators 37 are associated with the drive device 30.

The purpose of the accumulators 37 is to supply energy to the electric motor 33 which drives all the user devices of the boom 17 which are hydraulically driven, as described above.

Such accumulators 37 can be charged by means of a charging device 38 which the present mobile lifting apparatus 10 is provided with. By means of the charging device 38 it is possible, advantageously, to charge the accumulators 37 by connection to a normal mains power network 35 before the mobile lifting apparatus 10 reaches the work site.

Advantageously, by means of such accumulators 37, preferably charged before the lifting apparatus 10 departs to reach the work site, it is possible to store a considerable amount of energy to then be used once it arrive at the work site to move the boom 17 and the hydraulically actuated user devices associated with it.

If, however, it were necessary to recharge the accumulators even in locations where a mains power network 35 was not present, it is possible to provide the connection between the accumulators 37 and the converter 29 associated with the drive device 12, as shown in FIG. 2.

The mobile lifting apparatus 10 according to the invention can comprise an energy recovery device 39 associated with one of the user devices 31 of the boom 17.

The energy recovery device 39 in particular exploits the force of gravity of the end working part 20 during its lowering with respect to the boom 17.

As previously described, one of the user devices 31 of the boom 17 can be the drive machine 36 for lifting and lowering the end working part 20. As stated above, the drive machine 36 can provide a winch associated with an electric generator, or an electric machine.

During the lifting operations of the end working part 20, see arrow A of FIG. 3*a*, the accumulators 37 supply energy to the electric motor 33, through the converter 32, then by means of the power transmission means 34 the pump associated with the drive machine 36 will be driven, if the latter consists of a winch. If the drive machine 36 is an electric machine, the accumulators 37 supply energy directly to the electric machine.

With the drive machine 36 there is associated an energy converter 40, for example an inverter, which can be associated with the accumulators 37.

During the lowering of the end working part 20, see arrow B in FIG. 3*b*, the drive machine 36, turning in the opposite sense to the lifting step, recovers energy and this energy, by means of the converter 40, is preferably stored in the accumulators 37.

Therefore, unlike standard cranes where the lowering of the end working part 20 is managed by means of hydraulic and mechanical drives, such as pumps, brakes or suchlike, in the present mobile lifting apparatus 10 the descent or lowering step of the end working part 20 is managed electrically, by means of the drive machine 36, which—as stated—can be an electric machine managed electrically both during the lifting and also during the lowering of the end working part 20, and an electric winch coupled to an electric generator. In both cases, the force of gravity of the end working part 20 is exploited during its descent to recover energy and store it in the accumulators 37.

The diagram of FIG. 4 shows how the energy recovery device 39 is integrated with the drive device 12 of the truck 11, based substantially on at least one internal combustion engine 25, and with the drive device 30 configured to drive the boom 17 and the hydraulically actuated user devices connected thereto, therefore for example the user devices 31, and based substantially on at least one electric motor 33.

As it has been observed, the use of a drive device 30 comprising at least one electric motor 33 to move the boom 17 and the hydraulically actuated user devices connected to it allows to save energy, reduce the emissions of harmful and polluting substances into the environment and also reduce the noise pollution deriving from the use of boom 17 and its user devices during normal work operations.

The present mobile lifting apparatus 10 therefore proves to be extremely efficient and performing compared to the lifting apparatuses known in the sector and provided with at least two internal combustion engines, one to move the truck and one to move the boom and drive the user devices connected to it.

The present mobile lifting apparatus 10 can also advantageously be provided with an energy recovery device 39 which allows to recover part of the energy spent in the various work operations of the boom 17, for example providing to recover energy during the step of descent by gravity of the end working part 20 of the boom 17.

It is clear that modifications and/or additions of parts may be made to the mobile lifting apparatus as described heretofore, without departing from the field and scope of the present invention as defined by the claims.

It is also clear that, although the present invention has been described with reference to some specific examples, a person of skill in the art shall certainly be able to achieve many other equivalent forms of mobile lifting apparatus, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A mobile lifting apparatus, comprising: at least one truck, provided with a first drive device comprising at least one internal combustion engine connected by power transmission means to one or more user devices of the truck hydraulically actuated, and at least one boom comprising an arm, wherein the boom is associated with a second drive device, wherein said second drive device comprises at least one electric motor connected by power transmission means to one or more user devices of the boom, wherein said user devices are selected between one or more first actuators used to make the boom rotate with respect to the truck, a movement device, one or more second actuators used to extend tubular elements of the arm, and a drive machine for lifting and lowering an end working part, wherein said first drive device comprises an electric generator connected to said power transmission means and connected by at least one first energy converter to one or more accumulators.

2. The mobile lifting apparatus as in claim 1, wherein said electric motor of said second drive device is connected by at least one second energy converter to said one or more energy accumulators.

3. The mobile lifting apparatus as in claim 2, comprising at least one charging device connectable to a mains power network and configured to recharge said one or more accumulators.

4. The mobile lifting apparatus as in claim 1, comprising an energy recovery device associated with at least one of the user devices of the boom.

5. The mobile lifting apparatus as in claim 4, wherein said energy recovery device is associated with the drive machine configured to lift or lower said end working part, wherein, at least in a step of lowering said end working part due to gravity, said drive machine functions as an electric generator.

6. The mobile lifting apparatus as in claim 5, wherein said drive machine is a winch with which said electric generator is associated.

7. The mobile lifting apparatus as in claim 5, wherein said drive machine is an electric machine.

8. The mobile lifting apparatus as in claim 5, wherein said energy recovery device comprises at least one third energy converter associated with said drive machine and by means of which said energy is transferred to said one or more accumulators.

* * * * *